US008621678B2

(12) United States Patent
Miller

(10) Patent No.: US 8,621,678 B2
(45) Date of Patent: Jan. 7, 2014

(54) FREEZE PREVENTION FOR A SPA HAVING A SPA PACK POWERED THROUGH A GROUND FAULT CIRCUIT INTERRUPTER

(76) Inventor: Daniel J. Miller, Lac du Bonnet (CA)

( * ) Notice: Subject to any disclaimer, the term of this patent is extended or adjusted under 35 U.S.C. 154(b) by 306 days.

(21) Appl. No.: 13/042,555

(22) Filed: Mar. 8, 2011

(65) Prior Publication Data

US 2011/0225721 A1 Sep. 22, 2011

(30) Foreign Application Priority Data

Mar. 17, 2010 (CA) ..... 2696803

(51) Int. Cl.
*A47K 3/00* (2006.01)

(52) U.S. Cl.
USPC ..... 4/541.2

(58) Field of Classification Search
USPC ..... 4/541.1–541.6, 493; 219/494, 497
See application file for complete search history.

(56) References Cited

U.S. PATENT DOCUMENTS

| | | | | |
|---|---|---|---|---|
| 6,590,188 | B2 * | 7/2003 | Cline et al. | 219/497 |
| 7,514,652 | B2 * | 4/2009 | Elnar | 219/481 |
| 2002/0020014 | A1 * | 2/2002 | Authier et al. | 4/541.2 |

FOREIGN PATENT DOCUMENTS

| | | | |
|---|---|---|---|
| JP | 07260256 A | * | 10/1995 |
| JP | 08226145 A | * | 9/1996 |

OTHER PUBLICATIONS

English machine translation of JP07260256A.*
English machine translation of JP08226145A.*

* cited by examiner

*Primary Examiner* — Huyen Le
*Assistant Examiner* — Christine Skubinna
(74) *Attorney, Agent, or Firm* — Kyle R. Saherthwaite; Ryan W. Dupuis; Ade & Company Inc.

(57) ABSTRACT

Systems and methods for preventing water from freezing in a spa or hot tub featuring a spa pack having a pump, heater and controller connected to a spa power supply through a ground fault circuit interrupter. A sensor is used to monitor an operating condition of the spa pack that is initially electrically connected to the spa power supply in order to activate at least one freeze prevention device if the operating condition of the spa pack changes due to electrical disconnection from the spa power supply by the ground fault circuit interrupter. The freeze prevention device features a heater, a circulating pump or both, and keeps water in the tub and the piping associated therewith from freezing. A switching arrangement is provided for deactivating the system outside the winter season when freeze protection is not required.

19 Claims, 3 Drawing Sheets

FREEZE PREVENTION FOR A SPA HAVING A SPA PACK POWERED THROUGH A GROUND FAULT CIRCUIT INTERRUPTER

CROSS REFERENCE TO RELATED APPLICATIONS

This application claims benefit under 35 U.S.C. 119 of Canadian Patent Application Serial No. 2,696,803, filed Mar. 17, 2010.

FIELD OF THE INVENTION

The present invention relates generally to spas, and more particularly to spas in climates having cold weather seasons during which unheated water in the spa may freeze and cause damage.

BACKGROUND OF THE INVENTION

It is well known to use spas, also commonly referred to as hot tubs, outdoors during cold weather seasons to provide an enjoyable experience using the contrast of the cold ambient outdoor temperature and the heated water of the spa. However, a known problem with winter use of an outdoor spa is that if power is cut off to the water circulating pump and heater of the spa, the water in the tub and in the pipework connected thereto can easily freeze if ambient conditions are cold enough, and the expansion of the water as it freezes can cause cracks to form in the tub or pipes, which can lead to leaks when the water thaws and can require costly or time consuming repair or replacement of components or entire systems.

The powered components of a spa include a water heater, at least one pump for circulating water through pipes interconnecting the heater and the tub, and a controller operable to control the pump and the heater in response to input from an owner, operator or user of the spa. Collectively, these components are often referred to as a spa pack. The spa pack is typically connected to a power source through a ground fault circuit interrupter (GFCI), which will disconnect electrical communication between the spa pack and the power source if a ground fault is detected in order to remove a potential electrocution hazard. This is problematic during winter use of the spa, in that if the GFCI cuts off the power supply to the spa pack and the hot tub is left unattended, the water can quickly freeze, especially in the circulation pipes, and cause damage to the spa. Operating spas are sometimes left unattended for extended periods of time during the cold weather season, for example by cottage owners who transit back and forth between a rural cottage and an urban environment and leave their cottage spa running between visits during the winter season to prevent freezing. Should the GFCI trip in their absence, they will likely return to find their spa frozen when the next retreat to the cottage.

Accordingly, it is desirable to provide freeze protection for spas suing ground fault protected spa packs.

SUMMARY OF THE INVENTION

According to a first aspect of the invention there is provided a freeze prevention system for a spa system having a spa pack including a pump, a water heater and a controller connected to a spa power supply by a ground fault circuit interrupter, the freeze prevention system comprising:

a sensor operable to detect electrical disconnection of the spa pack from the spa power supply; and at least one freeze prevention device arranged to activate in response to detection of the electrical disconnection of the spa pack from the spa power supply by the sensor.

According to a second aspect of the invention there is provided a spa system having freeze prevention capabilities, the spa system comprising:

a spa tub for holding water;

a spa pack comprising a pump, a water heater and a controller connected to a spa power supply by a ground fault circuit interrupter, the water heater being connected to the spa tub by piping and the pump being installed on the piping for circulating water between the water heater and the spa tub;

a sensor operable to detect electrical disconnection of the spa pack from the spa power supply; and at least one freeze prevention device arranged to activate in response to detection of the electrical disconnection of the spa pack from the spa power supply by the sensor.

According to a third aspect of the invention there is provided a method for preventing water from freezing in a spa system having a spa pack including a pump, a water heater and a controller connected to a spa power supply by a ground fault circuit interrupter, the method comprising:

(a) monitoring an operating condition of an initially operating spa pack electrically connected to the spa power supply; and (b) activating at least one freeze prevention device if the operating condition of the spa pack changes due to electrical disconnection from the spa power supply by the ground fault circuit interrupter.

Preferably the sensor comprises a relay.

Preferably the at least one freeze prevention device is arranged for connection to a second power supply distinct from the spa power supply.

The second power supply may be of lower voltage than the spa power supply.

Preferably the at least freeze prevention device is arranged to connect to a second ground fault circuit interrupter.

Preferably the at least one freeze prevention device comprises a heater.

The heater may be a space heater sized for receipt within a housing of the spa.

Preferably the at least one freeze prevention device comprises an auxiliary pump for use on a circulation line of the spa.

The circulation line may comprise the piping on which the pump of the spa pack is installed, the auxiliary pump being installed in parallel with the pump of the spa pack. In this instance, preferably at least one valve is installed between the pump of the spa pack and the auxiliary pump and is arranged to open in response to detection by the sensor of the absence of the electrical connection between the spa power supply and the spa pack.

Preferably there is provided an alarm condition indicator arranged to activate in response to detection by the sensor of the absence of the electrical connection between the spa power supply and the spa pack.

Preferably there is provided a switch operable to activate and deactivate the sensor.

Preferably the switch is used to activate the sensor at the start of a winter season, and deactivate the sensor at the end of the winter season.

BRIEF DESCRIPTION OF THE DRAWINGS

In the accompanying drawings, which illustrate a exemplary embodiment of the present invention.

DETAILED DESCRIPTION

Figure 1:
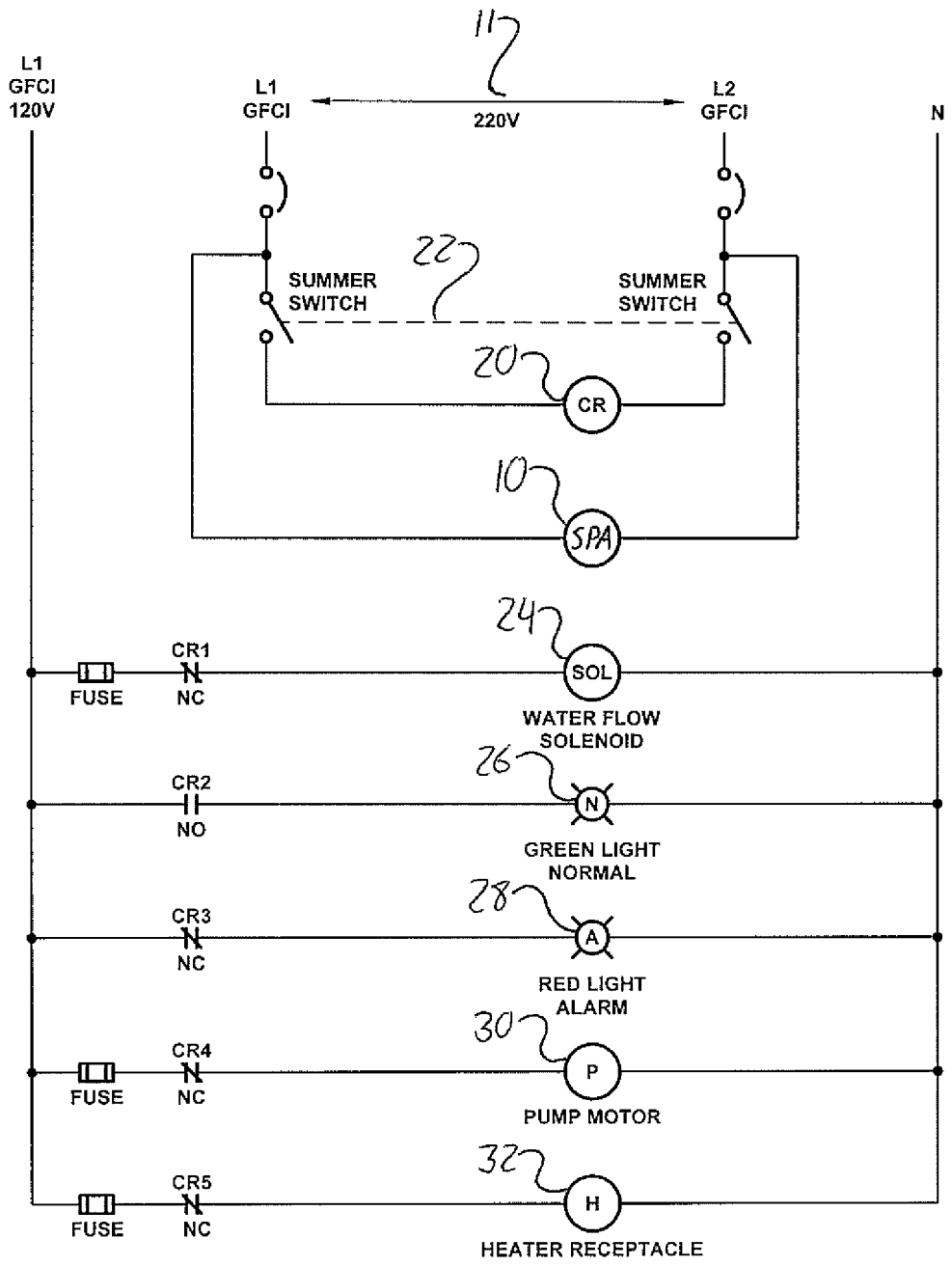
FIG. 1 is a schematic diagram of a first embodiment freeze protection system installed on a spa.

FIG. 1 schematically show a spa installation 10 which, in a conventional manner, incorporates a spa pack including a pump and a water heater installed on a circulation line within a housing or enclosure of the tub of the spa, and a control unit installed at the tub enclosure to present a control panel operable by occupants of the tub when in use. The spa back is wired to the two hot lines L1, L2 of a 220V electrical supply 11 via a ground fault circuit interrupter (GFCI) so that the GFCI will trip upon detection of a ground fault in order to interrupt the connection between the power supply and the operating spa pack, this electrical disconnection acting to shut down the previously powered spa pack to remove a potential electrical hazard.

The freeze protection system of the present invention ties into this conventional spa pack setup by placing a control relay 20 across the power supply lines L1, L2 in parallel with the spa pack between the GFCI and the spa pack. A double pole single throw switch 22 on opposite sides of the control relay between the lines L1, L2. This switch 20 is operable to control activation and deactivation of the freeze protection system. At the start of a season or groups of season in which below freezing temperatures are expected and the spa is continuously run to avoid freezing, the switch 22 is closed by an owner or operator of the spa which energizes the control relay by allowing current flow therethrough from the 220 v power supply 14 via the reset or untripped GFCI. The control relay is used as a sensor to monitor the operating condition of the spa pack. Operation of the spa pack is confirmed by current flow through the control relay 20, but if the GFCI is triggered and accordingly electrically disconnects the spa pack from the power supply 14, the spa pack ceases to operate and this inactive operational state of the spa pack is reflected by the lack of current flow through the control relay 20 due to the opening of the circuit a the GFCI. Using the relay to detect that the spa pack is no longer operational, and that the spa's primary water heater and pump in the spa pack are therefore no longer operable to heat and circulate the water in the spa, the system then activates its own freeze prevention devices to keep the water in its liquid state.

Still referring to FIG. 1, the relay 20 of the first embodiment is provided with five contact sets CR1, CR2, CR3, CR4, CR5 wired to its controlled output circuit. This output circuit is powered by a 120V power supply separate from the 220V power supply used by the spa pack, and features five components wired parallel to one another between the hot and neutral lines of the 120V power supply. Each contact set of the control relay is wired in series with a respective one of the five parallel components. The first contact set CR1 is normally closed and wired in series with a solenoid valve 24, the second contact set CR2 is normally open and wired in series with a normal operation indicator light 26, the third contact set CR3 is normally closed and wired in series with a solenoid valve 24 an alarm condition indicator light 28, the fourth contact set CR4 is normally closed and wired in series with the motor of an auxiliary pump 30 and the fifth contact set CR5 is normally closed and wired in series with an auxiliary heater 32. The solenoid valve, auxiliary pump and auxiliary heater are each protected by a respective fuse in series therewith. Although not shown, the output circuit of the relay incorporates an off switch for selectively connecting and disconnecting the components in this circuit to and from the 120V power supply. Accordingly, switching on and off of the freeze protection system is completed by switching on and off both the input circuit path of the relay, using switch 22 on the higher voltage circuit, and the output circuit path of the relay using the switch on the lower voltage circuit. The switch on the lower voltage circuit may be provided by a circuit breaker at the distribution panel providing the 120V power supply.

Figure 2:
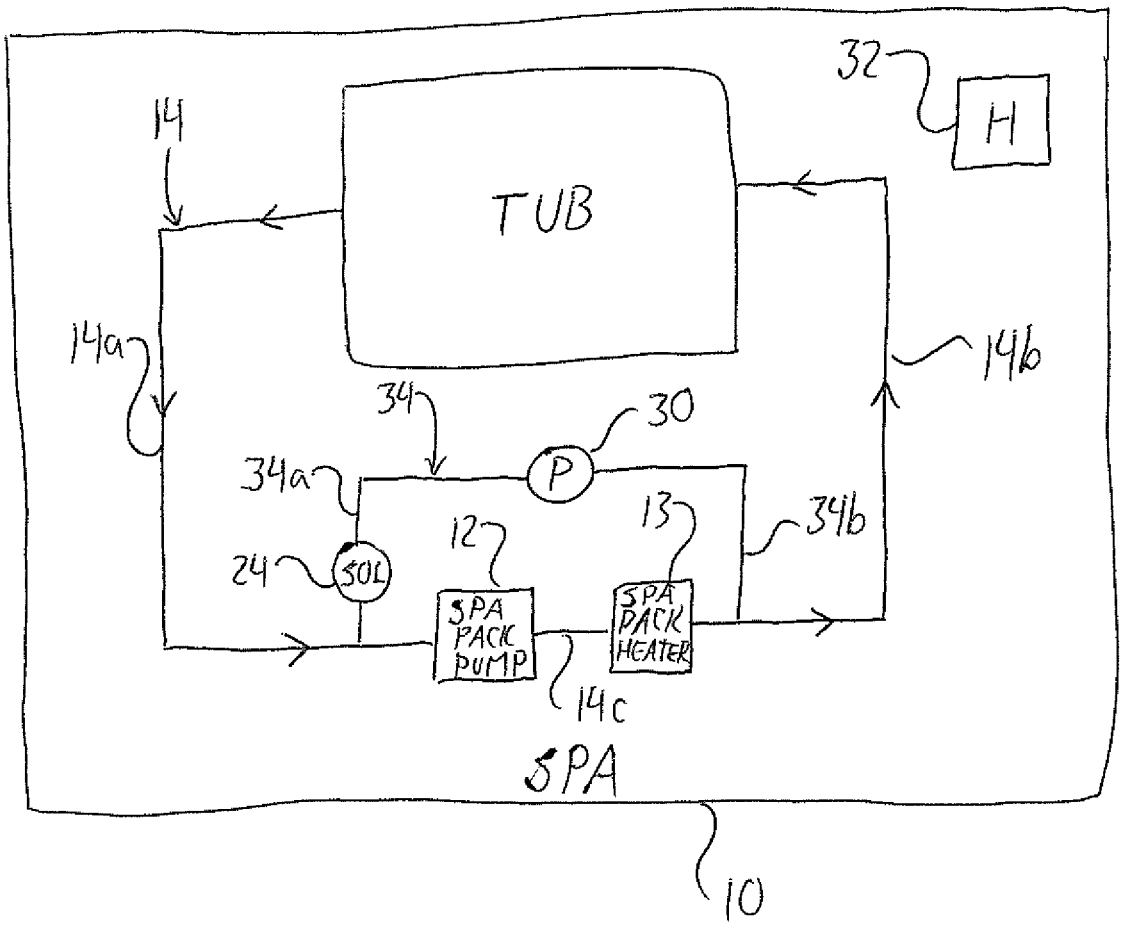
FIG. 2 is a schematic diagram of an auxiliary pump installed on an existing circulation line of the spa as part of the first embodiment freeze protection system.

Turning now to FIG. 2, the pump 12 and water heater 13 of the spa pack are installed in series in a normal fashion on a circulation line 14 made up of sections of piping fluidly communicating the spa pack pump 12 and water heater 13 to the tub 15 of the spa. The auxiliary pump 30 of the freeze prevention system is installed on the circulation line 14 in parallel with the primary pump 12 and heater 13 provided by the spa pack. A first primary section of circulation piping 14*a* connecting an outlet of the tub with an inlet of the primary pump 12 has a first auxiliary piping section 34*a* branching of the first primary section 14*a* between the tub 15 and the primary pump 12 to connect to the inlet of the auxiliary pump 30. From the outlet of the auxiliary pump 30, a second section 34*b* of auxiliary piping connects to a second primary section of circulation piping 14*b* connecting an outlet of the primary pump 12 with an inlet of the tub 15 at a position along this second primary section 34*b* between the primary heater 13 and the tub 15. A connecting section 14*c* of the primary piping interconnects the primary pump 12 and heater 13 in series. The solenoid valve 24 is installed on the first auxiliary piping section 34*a* and is biased to normally close this section of piping.

When the spa pack is operational, it controls the primary pump 12 and primary water heater 13 in a conventional manner to flow water through the primary circulation line 14, thereby passing water through the primary water heater 13 to elevate the temperature of the water flowing therethrough back to the tub 15. During this normal operation, the normally closed solenoid valve 24 closes off the flow into the auxiliary piping 34 and through the auxiliary pump 30 installed thereon. When the switches on the input and output circuits of the freeze prevention system are closed with the spa pack operating at the start of the cold season(s), the control relay is energized by the current running the spa pack from the higher voltage power supply. This energization of the control relay 20 opens the normally closed first contact set CR1, and the normally closed solenoid valve 24 is accordingly in a de-energized state closing off the auxiliary section 34 of the circulation line. The energized relay closes the normally open second contact set CR2, activating the normal operation indicator light 26 to provide visual feedback of the feed prevention system's operational status to the operator who activated it, and opens the normally closed third contact set CR3 so that the alarm condition indicator light is off. The energized relay opens the normally closed third and fourth contact sets CR4, CR5 so that the auxiliary pump and heater are inactive.

Should the GFCI on the input circuit of the control relay 20 be triggered and accordingly disconnect the previous electrical connection between the 220V power supply and the spa pack, this same disconnection will cut off current flow in through the control side of relay. This switching of the relay from an energized to de-energized state to reflect the now non-operational state of the spa pack switches the open/closed state of each of the relay's contact sets. Accordingly, the first, third fourth and fifth contact sets CR1, CR3, CR4, CR5 are returned to their normally closed states, thereby conductively linking the solenoid valve 24, the alarm condition indicator light 28, auxiliary pump 30 and auxiliary heater 32 with the 120V power supply. This energizes the valve to open the auxiliary sections 34 of the spa's circulation line, activates the auxiliary pump 30 to circulating water through the circulation line from and back to the tub via the auxiliary circulation section 34, and activates the auxiliary heater to continue to heat the water to prevent freezing. The alarm condition indicator light 28 provides a visual indicator that the freeze prevention system has activated, so that an operator will realize the spa pack has cut out and may require resetting of the GFCI or some other repair or maintenance.

If the spa pack returns to proper functionality after resetting of the GFCI, then the closing of the relay's input control circuit by the GFCI re-establishment of electrical connection to the power supply, then the relay will once again energize, thereby closing the solenoid valve, re-illuminating the normal condition indicator light, and deactivating the alarm condition indicator light, the auxiliary pump and the auxiliary heater. The spa pack continues to function in a normal manner until either the GFCI is tripped again, or the spa pack and freeze prevention system are shut down at the end of the freeze-risk season(s). On the other hand, if the spa pack fails to restart or run continuously upon resetting of the GFCI, the auxiliary motor and pump and alarm indicator will continue to operate or again initialize to prevent the water in the spa from freezing and inform any present party of the spa pack's failure. If the spa pack is unable to function properly, the owner of the spa may shut down the freeze prevention system, drain the water from the spa system and arrange for repair of problem or wait until the expiry of the cold weather season(s) to further address the problem. For safety reasons, the output or controlled circuit of the relay is preferably protected by another GFCI, in which case freezing is still possible should both GFCIs be tripped, but the risk of spa damage due to freezing is still significantly reduced by the addition of the freeze prevention system as an emergency backup to the spa pack.

The auxiliary heater is preferably a space heater disposed within the tub enclosure of the spa so as to warm the space inside this enclosure. Heat thereby transfers to the circulation pipes within this space, and thus to the water being pumped therethrough by the auxiliary pump, and also transfers to the tub itself and the volume of water therein. However, other embodiments may employ other arrangements, like an inline auxiliary water heater installed on the circulation line for feeding of water therethrough under operation of the auxiliary pipe or use of heat tape on circulation piping, provided the amount of water heating is sufficient together with the circulation to prevent freezing. Minimum heating and circulation requirements may vary depending on variations in climate conditions (temperature) and size of tub (volume of water). It may also be possible to attain sufficient performance through use of circulation without heat, or heat without circulation.

In the illustrated embodiments the spa pack and the freeze prevention components are powered by power supplies of different voltages, but other embodiments are also possible. For example, some spa packs will run off a 120V power supply, and It may also be possible to turn the freeze prevention components off a 220V power supply in 220V spa pack embodiments. In either of these alternate cases, the same voltage of power supply could be used on both relay circuits. It may be possible to wire both circuits of the relay off a single power supply by wiring the controlled output side of the relay to the spa power supply before and parallel to the GFCI protecting the spa pack. However, the freeze prevention system of the illustrated embodiments that runs off lower voltage than the spa pack is intended to provide enough heating and circulation of the water to prevent freezing, but not to provide sufficient levels for actual use of the spa. Accordingly, the freeze prevention system requires less power, as it is not intended to heat the water to the much higher temperatures achievable by the spa pack to prepare the tub for occupants.

The freeze protection system may be functional without the use of the valve to open and close a pathway to the auxiliary pump depending on the status of the spa pack and the freeze prevention system. On the other hand, a second valve may be added at the opposing outlet side 14*b* of the auxiliary circulation section to more fully close off this section when the spa pack is functioning properly. Further separation of the parallel sections of the overall circulation pipework may be provided by an additional one or two valves that open and close in opposition to that illustrated in the Figures, thereby closing off the pathway to the pump of the spa pack when the freeze prevention components activate. While the described embodiments include indicator lights to reflect that the relay is operational to sense the spa pack operational status and reflect when the spa pack has ceased operation, it will be appreciated that the number and type of indicators may change. For example, an audible alarm could replace the alarm condition light indicative of the spa packs shut down and the freeze protection activation. While indicators could be removed altogether, it is preferable that some feedback on the status of the system be provided for easy recognition by the spa owner/operator.

Components of the freeze protection system of the present invention may be sold as an add-on kit for wiring and or plumbing to existing spa packs, or may be incorporated into spa pack designs themselves. It will be appreciated that the present invention is compatible with spa pack designs of various configurations, including those which incorporate the GFCI as a built-in or included component and those which include more than a single pump. The relay-based illustrated embodiments provides a simple solution for detecting de-activation of the spa pack, but will be appreciated that other sensor arrangements may alternatively be employed to monitor conditions reflective of an operational status of the spa pack, and trigger activation of one or more freeze prevention components in response to de-activation of the spa pack. Furthermore, the conditions being monitored need not necessarily relate to characteristics of the electrical connection between the spa pack and its power supply. As an example, one or more sensors could instead monitor such conditions as water temperature in the spa to check whether the spa pack is operating properly.

Figure 3:
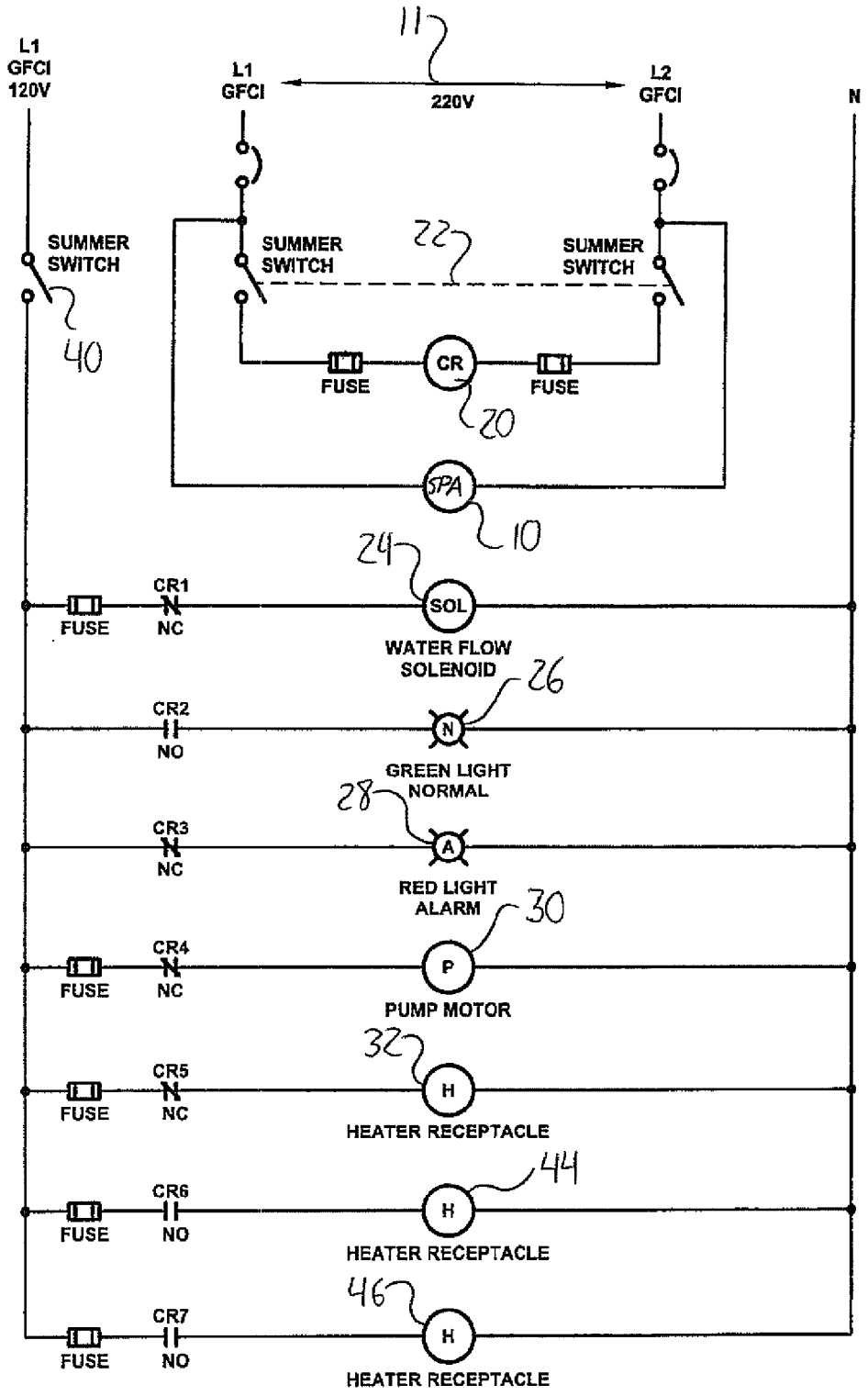
FIG. 3 is a schematic diagram of a second embodiment freeze protection system installed on a spa.

FIG. 3 shows a second embodiment similar to the first embodiment, but adding a single pole switch 40 on the 120V line, adding fuses on either side of the control rely 20, and featuring two additional heater devices 44, 46 wired respectively to two additional relay contact sets CR6, CR7, which are normally open so as to close when the control relay 20 is energized. The switch 40 acts as an off/on summer/winter switch to allow selective disconnection of the relay-controlled components from the 120V power supply when freeze prevention protection is not required. The additional heater devices 44, 46 are provided to deal with a situation which potentially arises where the solenoid 24 and auxiliary pump 30 become activated, then de-activated, leaving water behind in the by-pass line defined by the auxiliary pump and pipe. For example, this may occur where the spa pack GFCI is tripped, causing the freeze prevention system to kick in, but someone is on hand to reset the GFCI and finds that the spa thereafter reinitializes and runs without re-tripping.

In such a situation, the potential would exist for the water in this bypass line to freeze when the hot tub is in normal operation. Having said that, when the tub is in normal operation, and the control relay 20 thus being energized, the to additional relay contact sets CR6, CR7 will close, thus energizing the additional heating devices 44, 46, which may be provided in the form of a respective short length of self-regulating heat tape on the emergency auxiliary circulating pump 30 and on the solenoid 24. By energizing these additional heating devices during normal operation of the spa, there is self-regulating heat to keep the water left in the bypass lines from freezing during these normal operating conditions of the spa. As mentioned above, it may be possible to replace the emergency auxiliary heater 32, which comes on at loss of energy to the control relay 20, with a lower energy consuming heat tape instead of a space heater. This self-regulating heat tape could be taped onto the normal operating pump and possibly the supply and suction lines of the circulating pump.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A freeze prevention system for a spa system having a spa pack including a pump installed in a circulation line of the spa system, a water heater and a controller connected to a spa power supply by a ground fault circuit interrupter, the freeze prevention system comprising:

a sensor operable to detect electrical disconnection of the spa pack from the spa power supply; and at least one freeze prevention device arranged to activate in response to detection of the electrical disconnection of the spa pack from the spa power supply by the sensor;

wherein the at least one freeze prevention device comprises an auxiliary pump installed in the circulation line of the spa system in parallel with the pump of the spa pack.

2. The freeze prevention system of claim 1 comprising at least one heating device operable when the auxiliary pump is inactive to heat at least one of the auxiliary pump and a portion of the circulation line in parallel with the pump of the spa pack.

3. The freeze prevention system of claim 1 wherein at least one valve is installed between the pump of the spa pack and the auxiliary pump and is arranged to open in response to detection by the sensor of the absence of the electrical connection between the spa power supply and the spa pack.

4. A spa system having freeze prevention capabilities, the spa system comprising:

a spa tub for holding water;

a spa pack comprising a pump, a water heater and a controller connected to a spa power supply by a ground fault circuit interrupter, the water heater being connected to the spa tub by piping of a circulation line and the pump being installed on the piping for circulating water between the water heater and the spa tub;

a sensor operable to detect electrical disconnection of the spa pack from the spa power supply; and at least one freeze prevention device arranged to activate in response to detection of the electrical disconnection of the spa pack from the spa power supply by the sensor;

wherein the at least one freeze prevention device comprises an auxiliary pump installed in the circulation line in parallel with the pump of the spa pack.

5. The spa system of claim 4 wherein the at least one freeze prevention device is connected to a second power supply distinct from the spa power supply.

6. The spa system of claim 5 wherein the second power supply is of lower voltage than the spa power supply.

7. The spa system of claim 5 comprising a shutdown switch associate with the second power supply to selectively disconnect the freeze prevention device therefrom when use the freeze prevention system is not required.

8. The spa system of claim 4 wherein the at least one freeze prevention device is connected to a second ground fault circuit interrupter.

9. The spa system of claim 4 wherein the at least one freeze prevention device comprises a heater.

10. The spa system of claim 9 wherein the heater is a space heater situated within a housing of the spa.

11. The spa system of claim 4 comprising at least one heating device operable when the auxiliary pump is inactive to heat at least one of the auxiliary pump and a portion of the circulation line in parallel with the pump of the spa pack.

12. The spa system of claim 4 wherein at least one valve is installed between the pump of the spa pack and the auxiliary pump and is arranged to open in response to detection by the sensor of the absence of the electrical connection between the spa power supply and the spa pack.

13. The spa system of claim 4 further comprising an alarm condition indicator arranged to activate in response to detection by the sensor of the absence of the electrical connection between the spa power supply and the spa pack.

14. The spa system of claim 4 further comprising a switch operable to activate and deactivate the sensor.

15. A method for preventing water from freezing in a spa system having a spa pack including a pump installed on circulation line of the spa system, a water heater and a controller connected to a spa power supply by a ground fault circuit interrupter, the method comprising:

(a) monitoring an operating condition of an initially operating spa pack electrically connected to the spa power supply; and (b) activating at least one freeze prevention device if the operating condition of the spa pack changes due to electrical disconnection from the spa power supply by the ground fault circuit interrupter, including activating an auxiliary pump that is installed in the circulation line of the spa system in parallel with the pump of the spa pack.

16. The method of claim 15 wherein current flow during operation of the spa pack energizes a relay that de-energizes to activate the at least one freeze protection device when the current flow ceases.

17. The method of claim 15 wherein step (b) comprises electrically connecting the at least one freeze prevention device to a second power supply distinct from the spa power supply.

18. The method of claim 17 wherein the second power supply is of lower voltage than the spa power supply.

19. The method claim 17 comprising opening a shutdown switch between the second power supply and the at least one freeze prevention device when freeze protection is not required.

* * * * *